US009031429B2

(12) United States Patent
Shimao et al.

(10) Patent No.: US 9,031,429 B2
(45) Date of Patent: May 12, 2015

(54) GLOSS PROCESSING APPARATUS

(71) Applicants: Teruo Shimao, Osaka (JP) Toshie Shimao, Osaka (JP) Katsunori Takahashi, Tokyo (JP); Kenji Tamaki, Saitama (JP); Kenichi Hayashi, Tokyo (JP); Yumiko Izumiya, Tokyo (JP); Kazutoshi Yoshimura, Tokyo (JP)

(72) Inventors: Satoshi Shimao, Aichi (JP); Katsunori Takahashi, Tokyo (JP); Kenji Tamaki, Saitama (JP); Kenichi Hayashi, Tokyo (JP); Yumiko Izumiya, Tokyo (JP); Kazutoshi Yoshimura, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 74 days.

(21) Appl. No.: 13/761,580

(22) Filed: Feb. 7, 2013

(65) Prior Publication Data

US 2013/0206061 A1 Aug. 15, 2013

(30) Foreign Application Priority Data

Feb. 13, 2012 (JP) ..... 2012-28447

(51) Int. Cl.

| | |
|---|---|
| ***G03G 21/00*** | (2006.01) |
| ***B05C 11/00*** | (2006.01) |
| ***G03G 7/00*** | (2006.01) |
| ***G03G 8/00*** | (2006.01) |

(52) U.S. Cl.
CPC *B05C 11/00* (2013.01); *G03G 7/00* (2013.01); *G03G 8/00* (2013.01)

(58) Field of Classification Search
CPC ..... G03G 2215/00805
USPC ..... 399/45, 341
See application file for complete search history.

(56) References Cited

U.S. PATENT DOCUMENTS

| | | | | |
|---|---|---|---|---|
| 6,006,668 | A * | 12/1999 | Rehmann | 101/484 |
| 6,535,712 | B2 * | 3/2003 | Richards | 399/341 |
| 7,590,366 | B2 * | 9/2009 | Nakayama | 399/67 |
| 7,831,164 | B2 * | 11/2010 | Barton | 399/69 |
| 2006/0115306 | A1 * | 6/2006 | Lofthus et al. | 399/341 |

FOREIGN PATENT DOCUMENTS

JP 2010-211055 9/2010

* cited by examiner

*Primary Examiner* — Clayton E Laballe
*Assistant Examiner* — Leon W Rhodes, Jr.
(74) *Attorney, Agent, or Firm* — Lucas & Mercanti, LLP

(57) ABSTRACT

A sheet of paper is set on a paper-supplying portion of a top surface gloss processing apparatus while its top surface is faced upward. A gloss level sensor measures gloss level of the top surface of the sheet of paper. Data of this measurement is compared with a previously set threshold value. Based on this comparison, it is determined whether or not the gloss processing has been performed on the top surface thereof. When determining that the gloss processing has been already performed, a warning message such that the gloss processing has been already performed on the top surface of the sheet, of paper is displayed on a screen. On the other hand, when determining that the gloss processing has not performed, the top surface gloss processing apparatus performs the gloss processing on the top surface thereof.

8 Claims, 5 Drawing Sheets

GLOSS PROCESSING APPARATUS

CROSS REFERENCE TO RELATED APPLICATION

This application is based on Japanese Patent Application No. 2012-28447 filed with Japanese Patent Office on Feb. 13, 2012, the entire contents of which being hereby incorporated by reference.

BACKGROUND OF THE INVENTION

1. Field of the Invention

The present invention relates to a gloss processing apparatus which applies any glossy effect to a sheet of paper by performing a gloss processing on the sheet of paper on which any clear toner has been provisionally fixed.

2. Description of Related Art

In the recent year, in order to allow an image to be vividly represented in a printing field such as photograph(s), a photo book and a product leaflet, any gloss processing to enhance a glossy effect has been perforated. In the gloss processing, a clear toner has been generally applied to a top surface of the sheet of paper in which an image has been formed. The top surface of the sheet of paper then has any glossy effect by heating and pressing the clear toner to smooth the top surface, by putting a sheet-like thin film having any smoothness on a top layer of the image or by coating water-soluble varnish or ultraviolet curing materials on a top surface of the sheet of paper.

For example, Japanese Patent Application Publication No. 2010-211055 has disclosed an image forming apparatus that performs a series or a paper-supply processing, a printing processing and a glossing processing in one apparatus to control the glossy effect to be applied on the image based on property of the sheet of paper.

This image forming apparatus disclosed in Japanese Patent Application Publication No. 2010-211055 may have low productivity because it performs a series of processing from the image forming processing to the gloss processing in one apparatus. Since this image forming apparatus is not an apparatus for exclusive use of gloss processing, the image forming apparatus may be insufficient for compatibility of electro photographic output. It is thus difficult to obtain high glossy effect (for example, glossy effect that is greater than that by varnish coating).

On the other hand, apart from the image forming apparatus that performs such an image forming, a gloss processing apparatus that has an off-line configuration and is an apparatus for exclusive use of gloss processing has been developed, in such a gloss processing apparatus, the top surface side of a sheet of paper can have any glossy effect by, for example, re-melting clear toner layer, which has been provisionally fixed on an image forming side of a sheet, of paper, smoothing the surface thereof by using smoothing member, solidifying the smoothed clear toner layer by using cooling fans, and peeling the sheet of paper from the smoothing member.

SUMMARY OF THE INVENTION

Such a gloss processing apparatus, however, has an off-line configuration so that an operator moves a sheet of paper on which any clear toner has been provisionally fixed by a provisionally fixative apparatus to the gloss processing apparatus to set the sheet of paper in a paper-supplying tray therein by hand. In this moment, the operator may make a mistake in setting a sheet of paper, on which any gloss processing is not to be performed, in the paper-supplying tray of the gloss processing apparatus. For example, the operator may make a mistake in setting the sheet of paper, on which the gloss processing has already been performed, again in the paper-supplying tray in the gloss processing apparatus. In this case, since the gloss processing is twice performed on the same surface of the sheet of paper, attachment of the sheet of paper onto a gloss-allowing belt deteriorates so that a jam may occur in the gloss processing apparatus. Since gloss level of the surface of the sheet of paper also deteriorates, poor quality may occur in the image.

This invention addresses the above-mentioned issues and has an object to provide an improved gloss processing apparatus that is capable of preventing a jam from occurring in the gloss processing apparatus during a period of gloss processing or preventing any poor quality from occurring in the image.

To achieve the above-mentioned object, a gloss processing apparatus reflecting one aspect of the present invention contains a gloss processing portion that performs gloss processing on a sheet of paper on which clear toner has been provisionally fixed, a first gloss-level-measuring portion that measures a gloss level of one surface of the sheet of paper, the one surface being gloss-processed by the gloss processing portion, the first gloss-level-measuring portion being positioned at an upstream side of the gloss processing portion along a sheet-transferring direction, and a control portion chat controls the gloss processing portion to stop the gloss processing when the control portion determines that the gloss processing has been performed on the one surface of the sheet of paper based on a measurement result of gloss level of the one surface of the sheet of paper by the first gloss-level-measuring portion.

It is desirable to provide the gloss processing apparatus wherein the control portion determines that the gloss processing has been performed on the one surface of the sheet of paper when the gloss level measured by the first gloss-level-measuring portion exceeds a threshold value that is a criterion of the gloss level.

It is also desirable to provide the gloss processing apparatus wherein the first gloss-level-measuring portion contains plural sensors or a line sensor in which sensors are arranged on a line.

It is further desirable to provide the gloss processing apparatus further containing a second gloss-level-measuring portion that measures a gloss level of the one surface of the sheet of paper which has been passed through the gloss processing portion, the second gloss-level-measuring portion being positioned at a downstream side of the gloss processing portion along the sheet-transferring direction, wherein the control portion determines whether or not the gloss processing portion has properly performed the gloss processing on the one surface of the sheet of paper based on a measurement result of gloss level of the one surface of the sheet of paper by the second gloss-level-measuring portion.

It is additionally desirable to provide the gloss processing apparatus wherein the control portion determines whether or not the gloss processing portion has properly performed the gloss processing on the one surface of the sheet of paper by comparing the gloss level measured by the second gloss-level-measuring portion with a threshold value that is a criterion of the gloss level.

It is still further desirable to provide the gloss processing apparatus further containing a notifying portion which notifies that the gloss processing portion has not properly performed the gloss processing on the sheet of paper when the control portion determines that the gloss processing portion has not properly performed the gloss processing on the one surface of the sheet of paper.

It is still additionally desirable to provide the gloss processing apparatus wherein the second gloss-level-measuring portion contains plural sensors or a line sensor in which sensors are arranged on a line.

It is also desirable to provide the gloss processing apparatus further containing a paper-supplying portion that stores the sheet of paper on which the clear toner has been provisionally fixed and supplies the sheet of paper to the gloss processing portion, the paper-supplying portion being positioned at the upstream side of the gloss processing portion along the sheet-transferring direction, wherein the first gloss-level-measuring portion is arranged in the paper-supplying portion.

It is to be noted that in this invention, the term, "gloss" means luster, shininess and/or brightness on a surface of the sheet of paper. For example, the gloss level is fixed by an extent of light by regular reflection of the light irradiated on the surface of the sheet of paper.

The concluding portion of this specification, particularly points out and directly claims the subject matter of the present invention. However, those skilled in the art will best understand both the organization and method of operation of the invention, together with further advantages and objects thereof, by reading the remaining portions of the specification in view of tire accompanying drawing(s) wherein like reference characters refer to like elements.

DETAILED DESCRIPTION OF THE PREFERRED EMBODIMENTS

Hereinbelow, typical embodiments of this invention will be explained with reference to the drawings. It should be noted that the present invention is not limited to the embodiments described below. Definitions of terms described below are given by way of explanation of the terms only, and thus the definitions of the terms of the invention are not limited thereto.

The following will describe the preferred embodiments to carry out the invention.

[Workflow Example of Gloss Processing]

Figure 1:
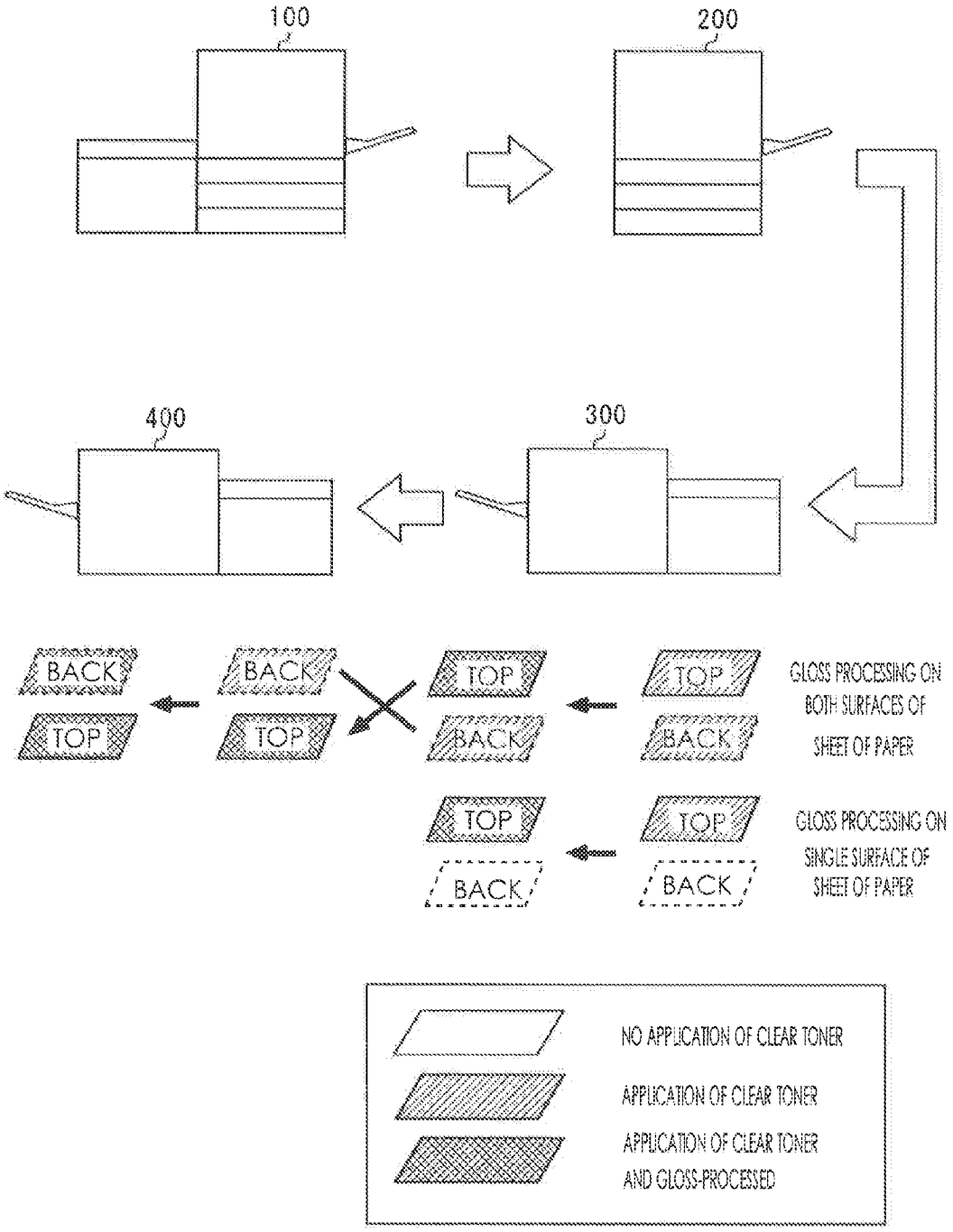
FIG. 1 is an outline diagram showing a workflow from an image forming step to a gloss processing step according to an embodiment of this invention.

First, a workflow from an image forming step in which images are formed on both surfaces of a sheet of paper P to a gloss processing step in which gloss processing is performed on both surfaces of the sheet of paper P will be described. FIG. 1 shows a workflow from the image forming step in which images are respectively formed on both surfaces of the sheet of paper P to the gloss processing step in which gloss processing is performed on each surface of the sheet of paper P, according to an embodiment of this invention. It is to be noted that following dimensions and/or ratios in the drawings may be emphasized for convenience of explanation and they may be different from their real values.

As shown in FIG. 1, to perform a series of the workflow from the image forming step to the gloss processing step, an image forming apparatus 100, a provisionally fixative apparatus 200, a gloss processing apparatus 300 for a top surface of the sheet of paper (hereinafter, referred to as "the top surface gloss processing apparatus 300"), and a gloss processing apparatus 400 for a back surface of the sheet of paper (hereinafter, referred to as "the back surface gloss processing apparatus 400") are used. In this embodiment, each apparatus is configured as off-line, namely, they are stand-alone apparatuses.

The image forming apparatus 100 forms a desired image on each surface of the sheet of paper P. As the image forming apparatus 100, any generally-used known image forming apparatus is used. Therefore, a detailed description of the image forming apparatus 100 will be omitted. When forming the desired, image on each surface of the sheet, of paper P, an operator moves the sheet of paper P, on both surfaces of which the images are formed, to the provisionally fixative apparatus 200 by hand and he or she sets the sheet of paper P on a paper-supplying portion of she provisionally fixative apparatus 200.

The provisionally fixative apparatus 200 applies any clear toner to each surface of the sheet of paper P, on both surfaces of which the images have been formed, to perform a provisional fixation processing. The provisional fixation processing is the processing in which the clear toner applied to the sheet of paper P is dissolved by heat so that it can be fixed on the sheet of paper P. The provisional fixation processing is the preprocessing stage of the gloss processing. This provisional fixation processing causes each surface of the sheet of paper P to have a mat appearance with low gloss. Since, as the provisionally fixative apparatus 200, any generally-used known one is ascot, a detailed description thereof will be omitted, similar to a case of the image forming apparatus 100. When finishing the provisional fixation processing, the operator moves the sheet of paper P, on each surface of which the provisional fixation processing is formed, from the provisionally fixative apparatus 200 to the top surface gloss processing apparatus 300 by hand and he or she sets the sheer, of paper P on a paper-supplying portion of the top surface gloss processing apparatus 300.

The top surface gloss processing apparatus 300 performs a top surface gloss processing mode for a top surface of the sheet of paper P. The top surface gloss processing mode is referred as a gloss processing mode performed when performing the gloss processing on the sheet of paper P, on a top surface (or one surface) of which any clear toner has been provisionally fixed. In this top surface gloss processing mode, fixing temperature, a transfer velocity of the sheet of paper and the like during the gloss processing are set so that they are suitable for a case of performing the gloss processing on the top surface of the sheet of paper P. For example, the fixing temperature is set to be 170° C. The transfer velocity of the sheet of paper is set to be 40 mm/sec. In this top surface gloss processing mode, when the sheet of paper P is transferred, the clear toner layer provisionally fixed on the top surface of the sheet of paper P is again dissolved by the heating nip portion and a cooling member (cooling fans 340, which will be described later) then cools the clear toner layer, which is again dissolved, of the transferred sheet of paper while the clear toner layer is closely contacted with a smoothing member (a gloss-allowing belt 338, which will be described later). This allows the clear toner layer to be solidified conforming to a shape of the smoothing member. After the clear toner layer has been solidified, the sheet of paper P is peeled from the smoothing member and the top surface of the sheet of paper P is granted any gloss.

When finishing granting the top surface of the sheet of paper P any gloss, the operator moves the sheet of paper P, on the top surface of which the gloss processing is formed, to the back surface gloss processing apparatus 400 by hand and he or she sets the sheet of paper P on a paper-supplying portion of the back, surface gloss processing apparatus 400 with the back surface of the sheet of paper P, on which the gloss processing has not been yet performed, being faced upward. The back surface gloss processing apparatus 400 performs a back surface gloss processing mode for a back surface of the sheet of paper P. The back surface gloss processing mode is referred as a gloss processing mode performed when performing the gloss processing on the sheet of paper P, on a back surface of which the clear toner has been provisionally fixed (but the gloss processing has been already performed on its top surface). In this back surface gloss processing mode, fixing temperature, a transfer velocity of the sheet of paper and the like during the gloss processing are sec so that they are suitable for a case of performing the gloss processing on the back surface of the sheet of paper P. For example, the fixing temperature is set to be 150° C. The transfer velocity of the sheet of paper is set to be 70 mm/sec. The reason why the fixing temperature is set to be lower than that of the top surface gloss processing mode and the transfer velocity of the sheet of paper is set to be faster than that of the top surface gloss processing mode is because the gloss processing has been already performed or; the top surface of the sheet of paper P and it is required to take into consideration any influence on glossy effect on this top surface, i.e., deterioration of image which is generated by dissolving the clear toner again. In the back surface gloss processing mode, the gloss processing that is similar to that of the top surface gloss processing mode is performed so that the back surface of the sheet of paper P is granted, any gloss. When allowing gloss on merely the single surface of the sheet of paper P, as shown in FIG. 1, only the top surface gloss processing apparatus 300 is used.

[Configuration Example of Top Surface Gloss Processing Apparatus]

Figure 2:
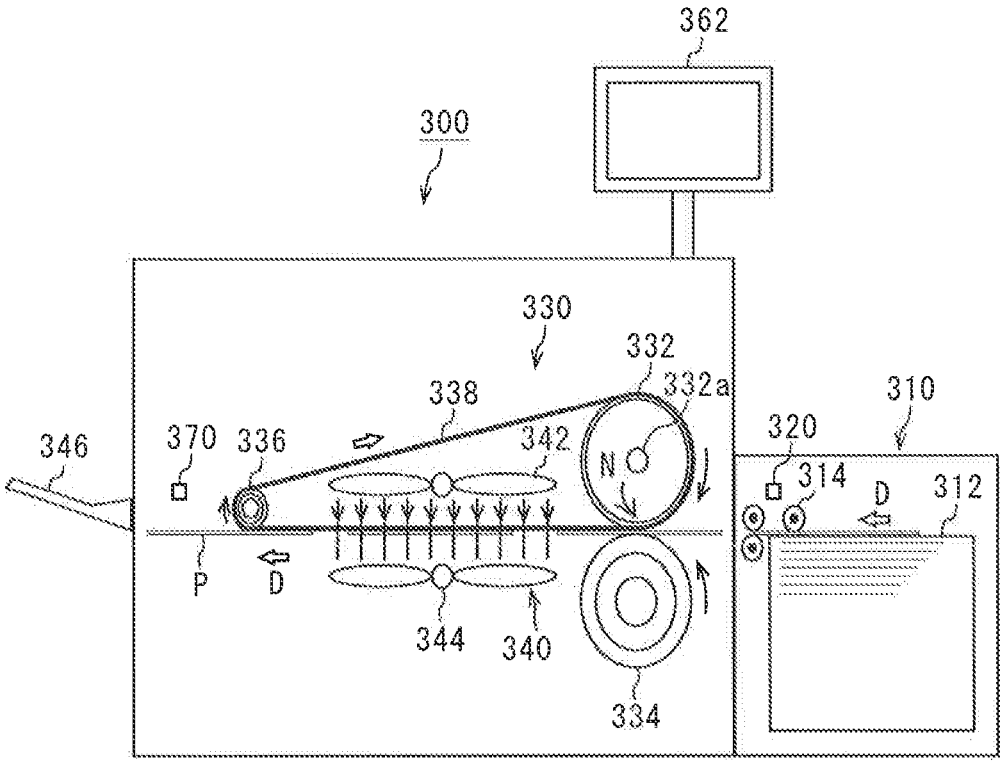
FIG. 2 is a diagram showing a configuration example of a gloss processing apparatus for a top surface of a sheet of paper.
Figure 3A:
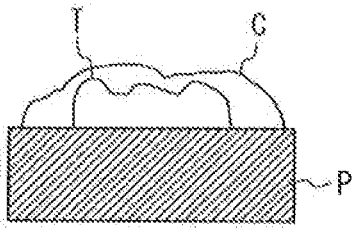
FIG. 3A is a diagram showing a step of the gloss processing in the gloss processing apparatus for the top surface of the sheet of paper.
Figure 3B:
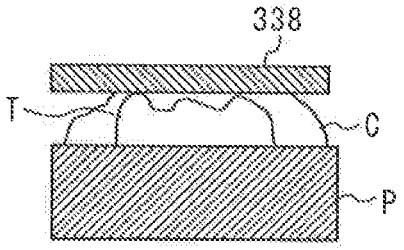
FIG. 3B is a diagram showing a step of the gloss processing in the gloss processing apparatus for the top surface of the sheet of paper.
Figure 3C:
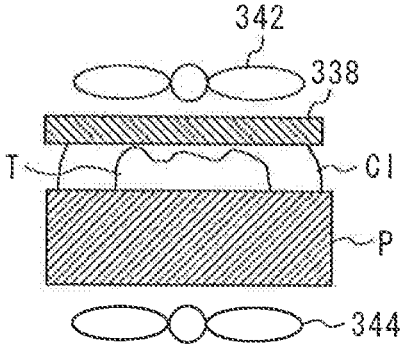
FIG. 3C is a diagram showing a step of the gloss processing in the gloss processing apparatus for the top surface of the sheet of paper.
Figure 3D:
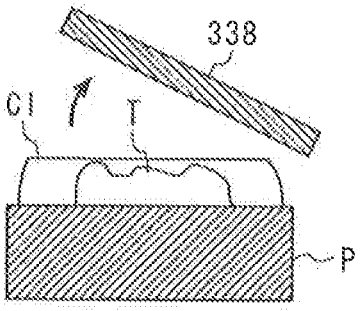
FIG. 3D is a diagram showing a step of the gloss processing in the gloss processing apparatus for the top surface of the sheet of paper.

The following will describe the top surface gloss processing apparatus 300. It is to be noted that since the back surface gloss processing apparatus 400 has the same configuration and function as those of the top surface gloss processing apparatus 300, a detailed description thereof will be omitted. FIG. 2 shows a configuration, example of the top surface gloss processing apparatus 300 according to this embodiment of the invention.

As shown in FIG. 2, the top surface gloss processing apparatus 300 includes a paper-supplying portion 310 and a gloss processing portion 330. The paper-supplying portion 310 is arranged at upstream side of the gloss processing portion 330 along a sheet-transferring direction D of the sheet of paper. The paper-supplying portion 310 includes a paper-supplying tray 312, a transfer roll 314 and a gloss-level-measuring portion 320. The paper-supplying tray 312 has a mounting table that is capable of being elevated. The sheet of paper P, on which the clear toner is provisionally fixed by the provisionally fixative apparatus 200*f* is set on the mounting table. The transfer roll 314 is arranged at a takeout side of the paper-supplying tray 312. The transfer roll 314 transfers the sheets of paper P taken out of the paper-supplying tray 312 one by one to the gloss processing portion 330 of downstream side.

The gloss-level-measuring portion 320 is an example of a first gloss-level-measuring portion and is composed of, for example, a gloss level sensor including optical source and a light receiving element. The gloss-level-measuring portion 320 is arranged near the takeout of the paper-supplying tray 312 and over a transfer path of the sheet of paper P. The gloss-level-measuring portion 320 irradiates light onto the top surface of the sheet of paper P which is being transferred to the gloss processing portion 330. The gloss level-measuring portion 320 then receives reflected light (for example, regular reflection) that, is reflected by the top surface of the sheet of paper P. Thus, the gloss-level-measuring portion 320 measures any gloss level of the top surface of the sheet of paper P. The gloss-level-measuring portion 320 may be configured so as to be a single sensor or plural sensors. The gloss-level-measuring portion 320 may be configured so as to be a line sensor in which gloss level sensors are arranged on a line. Such a gloss level sensor composed of plural sensors enables the gloss level of the top surface of the sheet of paper to be measured with high accuracy and preciseness.

The gloss processing portion 310 contains a manipulation display portion 362, a heating roll 332, a peel-off roll 336, the gloss-allowing belt 338, a pressure roll 334 and cooling fans 340. The manipulation display portion 362 is an example of a notifying portion. The manipulation display portion 362 is arranged at an upper surface of a housing of the top surface gloss processing apparatus 300. The manipulation display portion 362 receives any hinds of inputs by the operator, which are performed on a manipulation screen in a touch screen, such as setting of an operation mode and setting of a fixing condition including fixing temperature, a transfer velocity of the sheet of paper, a nipping pressure and the like. The manipulation display portion 362 displays a warning message such that a trouble occurs in the apparatus when the trouble occurs in the apparatus or the like during the gloss processing. It is to be noted that guidance by a voice or a buzzer to warn the operator may be used instead of such a warning message display.

The heating roll 332 is configured so as to have a cylindrical core barrel made of, for example, aluminum and a resin, layer of polytetraflouoroethylene (PTFE) which coats an outer surface of the core barrel. The heating roll 382 includes a heater 332*a* for heating the gloss-allowing belt 338. As the heater 332*a*, plural heaters may be arranged along a paper-width direction in order to correspond to sheets of paper having different, paper widths.

The peel-off roll 386 is arranged at a downstream side of the heating roll 332 along the sheet-transferring direction D of the sheet of paper P and at a position that, is away from the heating roll 332 by a predetermined distance. Accompanying with a rotation of the heating roll 332 or the like, the peel-off roll 336 rotates. An interval between the heating roll 332 and the peel-off roll 336 is selected so that the interval is an optimal distance by which, the sheet of paper P heated by the heating roll 332 can be cooled. The peel-off roll 336 has a function to peel the sheet of paper P which is closely contacted with the gloss-allowing belt 338 from the gloss-allowing belt 338 by its curvature.

The gloss-allowing belt 338 is configured so as to have a base body made of polyimide, an elastic layer made of heat-resistant silicon rubber, which coats an outer surface of the base body, and a coating layer made of Perfluoroalkoxy (PFA) fluororesin, which coats a top layer of the elastic layer. The gloss-allowing belt 338 is configured so as to be an endless belt and is stretched between the heating roll 332 and the peel-off roll 336. This enables the gloss-allowing belt 338 to be transferred following a rotation of the heating roll 332 or the like. The gloss-allowing belt 338 transfers the sheet of paper P along the sheet-transferring direction D of the sheet of paper P with smoothing the clear toner layer.

The pressure roll 334 is arranged below the heating roll 332 so that it faces the heat roll 332. The pressure roll 334 is configured so as to have a cylindrical core barrel made of, for example, aluminum, an elastic layer made of heat-resistant silicon, rubber, which coats an outer surface of the core barrel, and a resin layer made of PFA tube, which coats an outer circumference of the elastic layer. A nip portion N is formed between the pressure roll 334 and the heating roll 332 (or the gloss-allowing belt 338). The pressure roll 334 contacts the heating roll 332 with pressure via the gloss-allowing belt 338.

The cooling fans 340 are positioned on a transfer path between the heating roll 332 and the peel-off roll 336. In this embodiment, they are configured so as to be respectively arranged above and below the transfer path. The cooling fans 340 allow the sheet of paper P to be cooled from upward and downward directions, respectively. This enables the sheet of paper P that has been heated in the nip portion N to be cooled to a predetermined temperature so that the clear toner layer of image side can be solidified.

A gloss-level-measuring portion 370 is an example of a second gloss-level-measuring portion. The loss-level-measuring portion 370 is composed of, for example, gloss level sensor including optical source and a light receiving element. The gloss-level-measuring portion 370 is arranged at a downstream side of the peel-off roll 336 along the sheet-transferring direction D of the sheet of paper P and over a transfer path of the sheet of paper P. The gloss-level-measuring portion 370 irradiates light onto the top surface of the sheet of paper P which is being transferred from the gloss processing portion 330. The gloss-level-measuring portion 370 receives reflected light that is reflected by the top surface of the sheet of paper P. Thus, the gloss-level-measuring portion 370 measures any gloss level of the top surface of the sheet of paper P. Thus, the gloss-level-measuring portion 370 measures whether or not the gloss processing has been properly performed, on the transferring sheet of paper P in the gloss processing portion 330. The gloss-level-measuring portion 370 may be configured so as to foe a single sensor or plural sensors. The gloss-level-measuring portion 370 may be configured so as to be a line sensor in which gloss level sensors are arranged on a line. Such a gloss level sensor composed of plural sensors enables the gloss level of the top surface of the sheet of paper to be measured with high accuracy and preciseness.

[Example of Gloss Processing Steps]

The following will briefly describe gloss processing steps in the top surface gloss processing apparatus 300. FIGS. 3A through 3D schematically show gloss processing steps in the top surface gloss processing apparatus 300. The sheet of paper P on which the clear toner C is applied on an image T formed on the top surface thereof (see FIG. 3A) is set on the top surface gloss processing apparatus 300. When the top surface gloss processing apparatus 300 starts the gloss processing, the gloss-allowing belt 338 smooths a top surface of the clear toner C (see FIG. 3B). The cooling fans 342, 344 arranged above and below the transfer path cool the clear toner C so that the clear toner C is solidified (see FIG. 3C). This enables a smoothed clear toner layer C1 to be formed. Finally, the peel-off roll 336 peels the clear toner layer C1 from the gloss-allowing belt 338 (see FIG. 3D). The sheet of paper P on which the gloss processing has been performed, is ejected to a paper-ejection tray 346. Thus, the top surface gloss processing apparatus 300 grants the top surface of the sheet of paper P any gloss.

[Configuration Example of Top Surface Gloss Processing Apparatus]

Figure 4:
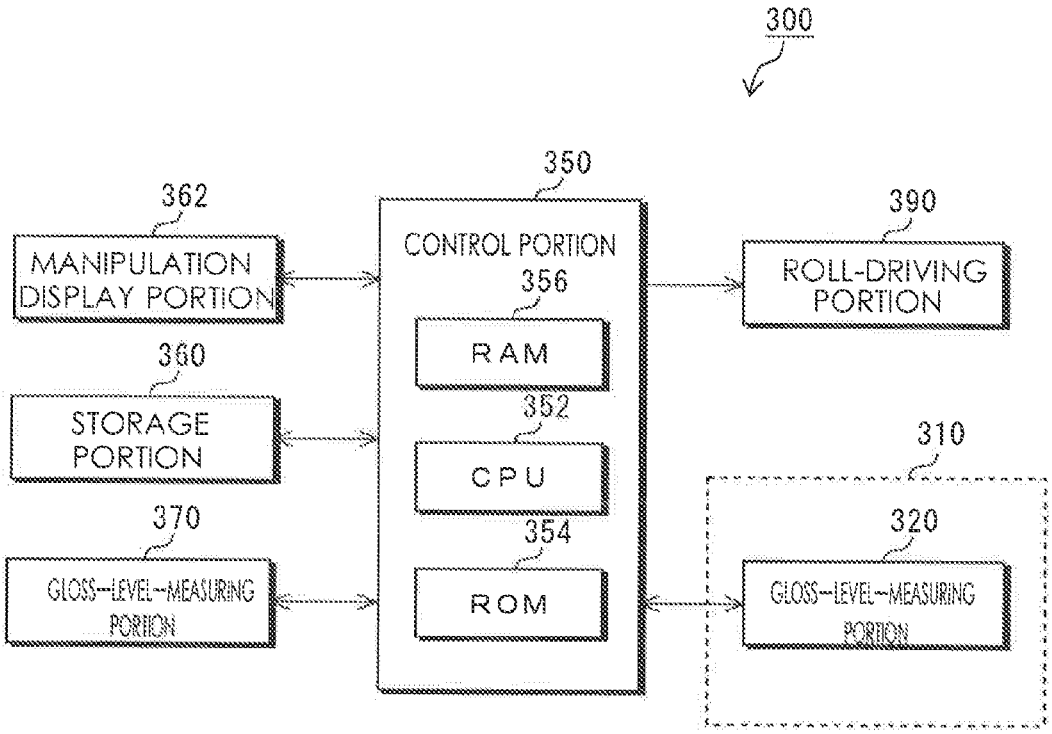
FIG. 4 is a block diagram showing a configuration example of the gloss processing apparatus for the top surface of the sheet of paper.

The following will describe a configuration example of the top surface gloss processing apparatus 300. FIG. 4 shows a configuration example of the top surface gloss processing apparatus 300. As shown in FIG. 4, the top surface gloss processing apparatus 300 contains a control portion 350 which controls operations of the whole apparatus. The control portion 350 includes central processing unit (CPU) 352, read only memory (ROM) 354 and random access memory (RAM) 356. The CPU 352 expands any programs and/or data read, out of the ROM 354 on the Ram 356 and starts the programs to perform the gloss processing. The gloss processing has a function to prevent the gloss processing from, being twice performed.

To the control portion 350, the manipulation display portion 362, the gloss-level-measuring portion 370, a storage portion 360, a roll-driving portion 390 and the gloss-level-measuring portion 320 are respectively connected. The manipulation display portion 362 is so configured as to have a touch screen in which a display portion composed of a liquid, crystal panel or the like and a position detection portion of capacitive sensing type or resistive film, type are combined. The manipulation display portion 362 receives any kinds of inputs such as a start or a stop of the gloss processing and any gloss processing conditions such as fixing temperature and a transfer velocity of the sheet of paper during the gloss processing, a nipping pressure and data on threshold values that are standards of gloss level used, when determining whether or not the gloss process has been performed. The manipulation display portion 362 supplies to the control portion 350 a manipulation signal corresponding to such receiving.

The storage portion 360 is configured as to be nonvolatile semiconductor device, hard disk drive (HDD) or the like. The storage portion 360 stores, for example, a table TB1 indicating any gloss processing conditions to be used when performing the top surface gloss processing, the data on threshold values (for example, 50° C.) to be used when determining whether or not the gloss process has been performed, and the like. In the table TB1 for the top surface gloss processing, for example, 170° C. is stored as a standard fixing temperature for the heater 332*a* and 40 mm/sec is stored as a standard transfer velocity of the sheet of paper.

The gloss-level-measuring portion 370 measures gloss level of the top surface of the sheet of paper P which has been passed through the gloss processing portion 330. The gloss-level-measuring portion 370 supplies any gloss level data based on a measurement result thereof to the control portion 350.

The roll-driving portion 390 is configured as to be, for example, a stepping motor. The roll-driving portion 390 drives the pressure roll 334 to rotate based on a driving signal according to the standard transfer velocity of the sheet of paper, which is supplied from the control portion 330. This rotation of the pressure roll 334 enables the heating roll 332 and the gloss-allowing belt 338 to be driven. Based on this, the gloss-allowing belt 338 rotates and the gloss-allowing belt 338 is transferred so that the sheet of paper P can be transferred along the sheet-transferring direction D thereof. It is to be noted that by connecting the roll-driving portion 390 with the heating roll 332, not the pressure roll 334, the heating roll 332 may rotate.

The control portion 350 reads the table TB1 corresponding to an operation mode (the top surface gloss processing mode), which is now set, out of the storage portion 360 and controls the heater 332*a* to tarn on electricity and to bring temperature of the nip portion N to the fixing temperature previously set in the table TB1. Similarly, the control portion 380 controls the roll-driving portion 300 to bring the transfer velocity of the sheet of paper to the one previously set in the table TB1 and controls the transfer of the sheet of paper P.

The gloss-level-measuring portion 320 is arranged in the paper-supplying portion 310. The gloss-level-measuring portion 320 measures any gloss level of the top surface of the sheet of paper P at the timing before the sheet of paper P is supplied to the gloss processing portion 330 and supplies to the control portion 350 any data on the gloss level based on this measurement result thereof.

It is to be noted that although in this embodiment, a case has been described in which the control portion 350 is separated from, the gloss processing portion 330 and controls the paper-supplying portion 310, this invention is not limited thereto: The control portion 350 may be contained in the gloss processing portion 330.

[Operation Example of Gloss Processing Apparatus]

Figure 5:
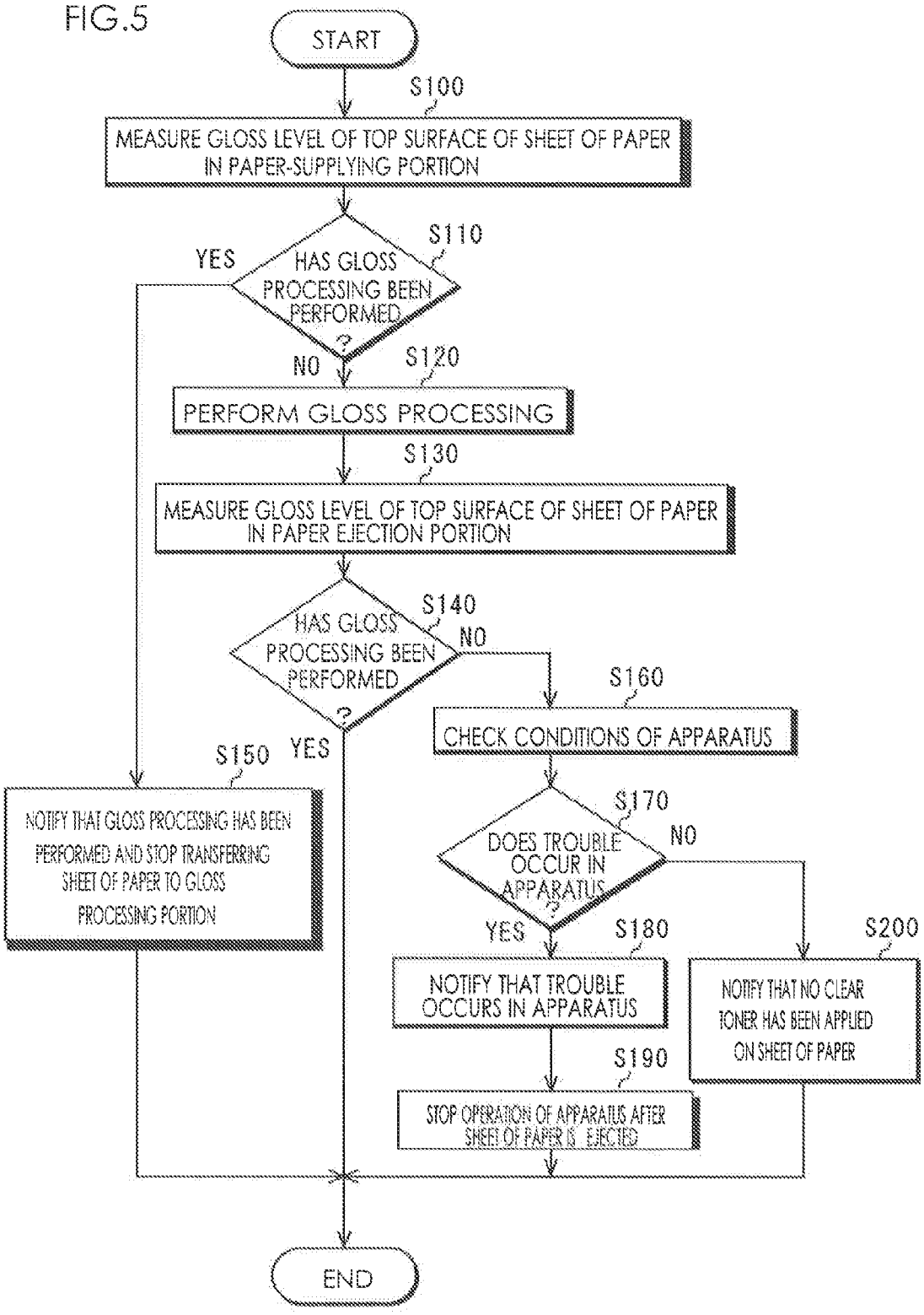
FIG. 5 is a flowchart showing an operation example of a control portion when performing the gloss processing on the top surface of the sheet of paper.

The following will describe operation example of the control portion 350 or the like when the top surface gloss processing apparatus 300 performs the gloss processing. FIG. 5 shows a flowchart indicating an operation example of the control portion 350 or the like when the top surface gloss processing apparatus 300 performs the gloss processing.

When the provisionally fixative apparatus 200 has provisionally fixed, the clear toner on the top surface of the sheet of paper P on which the image has been formed, the operator sets the sheet of paper P, on which the clear toner has been provisionally fixed, on the paper-supplying portion 310 of the top surface gloss processing apparatus 300 while the top surface of the sheet of paper P being faced upward. When the operator manipulates the manipulation screen of the manipulation display portion 362 to start the gloss processing, the program for the top surface gloss processing mode starts.

As shown, in FIG. 5, at a step S100, the control portion 350 controls the gloss-level-measuring portion 320 to measure any gloss level of the too surface of the sheet, of paper P taken out of the paper-supplying tray 312. The control portion 350 obtains trot; the gloss-level-measuring portion 320 the measurement data, which is; measured by the gloss-level-measuring portion 320, on the gloss level of the top surface of the sheet of paper P.

At a step S110, the control portion 350 determines whether or not the gloss processing has been performed on the top surface of the sheet of paper P taken out of the paper-supplying tray 312 based on the measurement data on the gloss level, which is obtained from the gloss-level-measuring portion 320. Particularly, the control portion 350 reads the threshold value, for example, 50° C., which is a standard gloss level, out of the storage portion 360 and determines whether or not the gloss level obtained from gloss-level-measuring portion 320 exceeds the previously set threshold value. The control portion 350 determines chat the gloss processing will not be performed on the sheet of paper P that will be supplied to the gloss processing portion 330, namely, the gloss processing has been, already performed thereon when the gloss level of the too surface of the sheet of paper P exceeds the previously set threshold value. The control portion 350 then, goes to a step S150. This is, for example, a case where nevertheless the gloss processing has been already completed on the top surface of the sheet of paper, the operator makes a mistake in setting again the sheet of paper P on the paper-supplying tray 312 of the paper-supplying portion 310 with the top surface of the sheet of paper P being faced upward. On the other hand, the control portion 350 determines that the gloss processing is to be performed from now on the sheet of paper P that is supplied to the gloss processing portion 330 when the gloss level of the top surface of the sheet of paper P does not exceed the previously set threshold value. The control portion 350 then goes to a step S120.

When the control portion 350 determines that the gloss processing has been already performed on the top surface of the sheet of paper p, the control portion 350 controls the manipulation display portion 362, at the step S150, to display on a screen thereof a warning message such that the gloss processing has been already performed on the too surface of the sheet of paper P that is supplied to the gloss processing portion 330. At the same time of this warning message display, the control portion 350 stops driving the transfer roll 314 of the paper-supplying portion 310 and stops transferring the sheet of paper P taken out of the paper-supplying tray 312 to the gloss processing portion 330. After the control portion 350 has stooped transferring the sheet of paper and the operator has taken the sheet of paper P out of the apparatus, the control portion 350 restarts the top surface gloss processing mode. Thus, since the sheet of paper P on which the gloss processing has been already performed can be prevented from being again gloss-processed, it is possible to prevent any jam from occurring and/or to prevent poor quality from occurring in the image. It is to be noted that any emergency withdrawal route may be provided and the sheet of paper P on which the gloss processing has been already performed may be transferred to such emergency withdrawal route. Such a configuration, enables the gloss processing on sheets of paper P which will be next supplied to be continuously implemented without any interruption of the gloss processing portion 33G.

On the other hand, when the control portion 350 determines that the gloss processing has not been yet performed on the top surface of the sheet of paper P, the control portion 350 controls the gloss processing portion 330, at the step S120, to perform the gloss processing on the top surface of the sheet of paper P on which the clear toner has been provisionally fixed. The control portion 350 reads the table TB1 out of the storage portion 360 and reads data on the gloss processing conditions such as the fixing temperature, the transfer velocity of the sheet of paper and the like in the table TB1. The control portion 350 sets the fixing temperature so as to be 170° C. based on this data on the gloss processing conditions and sets the transfer velocity of the sheet of paper so as to be 40 mm/sec. The control portion 350 then performs the gloss processing. This allows the top surface of the sheet of paper P to be granted, any gloss effect. When the gloss processing is finished, the sheet of paper P is transferred toward the paper ejection tray 346.

At a step S130, the control portion 350 controls the gloss-level-measuring portion 370, which is arranged on the transfer path between the peel-off roll 336 and the paper ejection fray 346, to measure any gloss level of the top surface of the sheet of paper P again. The control portion 350 obtains measurement data, which is measured by the gloss-level-measuring portion 370, of the gloss level of the top surface of the sheet of paper P from the gloss-level-measuring portion 370.

At a step S140, the control portion 330 determines whether or not the gloss processing has been performed on the top surface of the sheet of paper P passed through the gloss processing portion 330 based on a measurement data, which is obtained from the gloss-level-measuring portion 370, of gloss level of the top surface of the sheet of paper P. In other words, the control portion 330 determines whether or not the gloss processing has been properly performed on the top surface of the sheet of paper P. Particularly, the control portion 350 reads the threshold value, which is a standard gloss level, out of the storage portion 360 and determines whether or not the gloss level obtained from gloss-level-measuring portion 370 exceeds the previously set threshold value. In this embodiment, the threshold value that is the same value as that used in the step S110 is used. The control portion 350 determines that the gloss processing is properly performed on the sheet of paper P when the gloss level of the top surface of the sheet of paper P exceeds the previously set threshold value. The sheet of paper P on which the gloss processing is performed is then ejected to the paper ejection tray 346 and the gloss processing is performed on the sheet of paper P next transferred from the paper-supplying portion 310. On the other hand, the control portion 350 determines that the gloss processing portion 330 does not properly perform the gloss processing on the sheet of paper P and any trouble occurs in the apparatus or a paper-setting mistake occurs therein when the gloss level of the top surface of the sheet of paper P does not exceed the previously set threshold value. The control portion 350 then goes to a step S160.

At the step S160, the control portion 380 checks conditions of the gloss processing portion 330. For example, the control portion 350 obtains from a pressure sensor arranged near the nip portion N formed between the pressure roll 334 and the heating roll 332 (the gloss-allowing belt 338) the nipping pressure at the nip portion h. The control portion 350 also obtains from a velocity sensor arranged on the transfer path the transfer velocity of the sheet of paper P. The control portion 350 further obtains from a temperature sensor arranged near the nip portion N the temperature of the nip portion N. Eased on them, the control, portion 350 checks the gloss processing conditions of the gloss processing portion 330.

At a step S170, the control portion 350 determines whether or not any troubles occur in the gloss processing portion 330 based on the conditions information of the apparatus thus obtained. The control portion 350 determines whether or not the nipping pressure, the transfer velocity of the sheet of paper, and the temperature of the nip portion indicate abnormal conditions based on whether or not each value of the nipping pressure, the transfer velocity of the sheet of paper, and the temperature of the nip portion exceeds each of their previously set threshold values. When the control portion 350 determines that any value of them indicates abnormal condition, the control portion 350 determines that any troubles occur in the gloss processing portion 330 and goes to a step S180.

At the step S180, the control portion 350 controls the manipulation display portion 362 to display a warning message such that the trouble occurs in the gloss processing portion 330 on its screen. When a cause of the trouble can be identified, the control portion 350 may control the manipulation display portion 362 to display specific contents of the cause of trouble. For example, when the temperature of the nip portion N is lower than a previously set standard fixing temperature, the control portion 350 may control the manipulation display portion 362 to display so on its screen.

At a step S190, the control portion 350 allows ejecting the sheet of paper P passing through the gloss processing portion 330 to the paper ejection tray 346 and then stopping the operation of the top surface gloss processing apparatus 300. Thus, the interruption of the operation of the top surface gloss processing apparatus 300 can prevent any poor quality from occurring in the image of the sheet of paper P which will be supplied and/or prevent a jam from occurring.

On the other hand, when no trouble occur in the nipping pressure, the transfer velocity of the sheet of paper, and the temperature of the nip portion of the gloss processing portion 330 at a step S170, the control portion 350 determines that no trouble occur in the gloss processing portion 330 and goes to a step S200. Since it is not based on any trouble occurred in the gloss processing portion 330 why the gloss level of the top surface of the sheet of paper P is fewer than the previously set threshold value, at the step S200, the control portion 350 determines that any clear toner has not applied to the sheet of paper from the beginning. This is because even if any clear toner has not applied to the sheet of paper, the gloss level determined at the step S110 may be lower than the previously set threshold value and it may be determined that the gloss processing has not been performed on the sheet of paper P like the sheet of paper on which clear toner has been provisionally fixed. The control portion 350 controls the manipulation display portion 362 to display a message such that any clear toner has trot applied to the sheet of paper on its screen, when any clear toner has not applied to the sheet of paper P, this sheet of paper P is ejected without stopping the apparatus and the control portion 350 performs the gloss processing on the sheet of paper P which is next supplied. This is because the clear toner may be applied to the sheet of paper P which is next supplied. In this embodiment, such a series of operations enables the gloss processing.

As described above, according to this embodiment, it is possible to prevent the sheet of paper P, on which any gloss processing is not to be performed, from being again gloss-processed in the top surface gloss processing apparatus 300. For example, when the operator makes a mistake in setting the sheet of paper P, on the top surface of which the gloss processing has been already performed, on the top surface gloss processing apparatus 300, it is possible to prevent the gloss processing from ten no again performed on this sheet of paper P by controlling the gloss processing portion 330 to stop the gloss processing on the sheet of paper P. This can prevent a jam based on the less-attachment of the sheet of paper P onto the gloss-allowing belt 338 from occurring in the top surface gloss processing apparatus 300. This also can prevent any poor quality from occurring in the image based on any influence of moisture or the like.

Further, since, in this embodiment, the gloss-level-measuring portion 370 is also arranged at a downstream, side of the gloss processing portion 330 along the sheet-transferring direction D of the sheet of paper P, it is possible to determine whether or not the gloss processing is properly performed on the sheet of paper P. This enables reliability of the gloss processing apparatus to be easily improved with high accuracy. Further, even when the gloss processing is not performed on the sheet of paper P, it is possible to determine whether or not any trouble occurs in the top surface gloss processing apparatus 300 or there is another cause. This enables the reason why the gloss processing is not properly performed, on the sheet of paper to be identified so that the too surface gloss processing apparatus 300 can be returned to normal rapidly and appropriately.

The technical scope of this invention is not limited to the above-mentioned embodiment(s): It contains any various modifications or alterations to the above-mentioned embodiment (s), in a limitation without any deviation from a spirit of this invention. Although, in the above embodiment, a case where an operation to prevent the gloss processing from being again performed on the sheet of paper, on which the gloss processing has been already performed, has been applied, to the top surface gloss processing apparatus 300 has been described, this invention is not limited thereto. This invention can be applied to the back surface gloss processing apparatus 400. For example, in the back surface gloss processing apparatus 400, the sheet of paper P is set on a paper-supplying portion of the back surface gross processing apparatus 400 while the back surface of the sheet of paper P, on which gloss processing has not yen been performed, is faced upward (see FIG. 1). Gloss level on the back surface of the sheet of paper P to be gloss-processed is measured and the gloss level obtained by this measurement is compared, with a previously set threshold value. Based on this comparison, it is determined whether or not the gloss processing is performed on the back surface of the sheet of paper P. When determining that the gloss processing is performed on the back surface of the sheet of paper P, the control portion controls the gloss processing portion to stop the operation of the back surface gloss processing apparatus 400. On the other hand, when determining chat the gloss processing is not performed on the back surface of the sheet of paper P, the back surface gloss processing apparatus 400 performs the gloss processing thereon using a table for the back surface gloss processing. In the table for the back surface gloss processing, for example, the standard fixing temperature for the neater is set to be 150° C. and the standard transfer velocity of the sheet of paper is set to be 70 mm/sec. In addition, it is estimated that the gloss processing has been already performed properly on the top surface of this sheet, of paper in the top surface gloss processing apparatus 300.

It should be understood by those skilled in the art that various modifications, combinations, sub-combinations and alterations may occur depending on design requirements and other factors insofar as they are within the scope of the appended claims or the equivalents thereof.

What is claimed is:

1. A gloss processing apparatus comprising:

a gloss processing portion that performs gloss processing on a sheet of paper on which clear toner has been provisionally fixed, the gloss processing including smoothing the provisionally applied clear toner;

a first gloss-level-measuring portion that measures a gloss level of one surface of the sheet of paper, the one surface being gloss-processed by the gloss processing portion, the first gloss-level-measuring portion being positioned at an upstream side of the gloss processing portion along a sheet-transferring direction; and a control portion that controls the gloss processing portion to stop the gloss processing when the control portion determines that the smoothing has been performed on the one surface of the sheet of paper based on a measurement result of gloss level of the one surface of the sheet of paper by the first gloss-level-measuring portion.

2. The gloss processing apparatus according to claim 1 wherein the control portion determines that the gloss processing has been performed on the one surface of the sheet of paper when the gloss level measured by the first gloss-level-measuring portion exceeds a threshold value that is a criterion of the gloss level.

3. The gloss processing apparatus according to claim 1 wherein the first gloss-level-measuring portion contains plural sensors or a line sensor in which sensors are arranged on a line.

4. The gloss processing apparatus according to claim 1 further comprising a second gloss-level-measuring portion that measures a gloss level of the one surface of the sheet of paper which has been passed through the gloss processing portion, the second gloss-level-measuring portion being positioned at a downstream side of the gloss processing portion along the sheet-transferring direction, wherein the control portion determines whether or not the gloss processing portion has properly performed the gloss processing on the one surface of the sheet of paper based on a measurement result of gloss level of the one surface of the sheet of paper by the second gloss-level-measuring portion.

5. The gloss processing apparatus according to claim 4 wherein the control portion determines whether or not the gloss processing portion has properly performed the gloss processing on the one surface of the sheet of paper by comparing the gloss level measured by the second gloss-level-measuring portion with a threshold value that is a criterion of the gloss level.

6. The gloss processing apparatus according to claim 4 further comprising a notifying portion which notifies that the gloss processing portion has not properly performed the gloss processing on the sheet of paper when the control portion determines that the gloss processing portion has not properly performed the gloss processing on the one surface of the sheet of paper.

7. The gloss processing apparatus according to claim 4 wherein the second gloss-level-measuring portion contains plural sensors or a line sensor in which sensors are arranged on a line.

8. The gloss processing apparatus according to claim 1 further comprising a paper-supplying portion that stores the sheet of paper on which the clear toner has been provisionally fixed and supplies the sheet of paper to the gloss processing portion, the paper-supplying portion being positioned at the upstream side of the gloss processing portion along the sheet-transferring direction, wherein the first gloss-level-measuring portion is arranged in the paper-supplying portion.

* * * * *